US006391225B1

(12) United States Patent
Poirier

(10) Patent No.: US 6,391,225 B1
(45) Date of Patent: May 21, 2002

(54) PHOSPHATE ESTER HYDRAULIC FLUIDS WITH IMPROVED PROPERTIES (LAW935)

(75) Inventor: Marc-André Poirier, Sarnia (CA)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/512,871

(22) Filed: Feb. 25, 2000

(51) Int. Cl.[7] ..... C09K 5/00; B64C 13/40

(52) U.S. Cl. ..... 252/78.5; 252/78.1; 252/77; 252/71; 244/226

(58) Field of Search ..... 252/78.5, 78.1, 252/77, 71; 244/226

(56) References Cited

U.S. PATENT DOCUMENTS

| | | | | |
|---|---|---|---|---|
| 3,456,012 | A | 7/1969 | Swenson | 260/584 |
| 3,983,046 | A | 9/1976 | Sheratte | 252/78.5 |
| 4,007,123 | A | 2/1977 | Sheratte | 252/78.5 |
| 4,371,448 | A | 2/1983 | Knoblauch et al. | 252/78.1 |
| 4,486,324 | A | 12/1984 | Korosec | 252/49.3 |
| 5,094,667 | A | 3/1992 | Schilowitz et al. | 44/434 |
| 5,264,006 | A | 11/1993 | Schilowitz et al. | 44/434 |
| 5,320,768 | A | 6/1994 | Gutierrez et al. | 252/49.6 |
| 5,464,551 | A | 11/1995 | Deetman | 252/78.5 |
| 5,549,838 | A | 8/1996 | Miyagawa et al. | 252/75 |
| 5,817,606 | A | 10/1998 | Kinker et al. | 508/440 |

FOREIGN PATENT DOCUMENTS

| | | | |
|---|---|---|---|
| WO | WO96/17517 | 6/1996 | A01N/27/00 |

*Primary Examiner*—Mark Kopec
(74) *Attorney, Agent, or Firm*—Joseph J. Allocca

(57) ABSTRACT

A functional fluid that is particularly useful as an aircraft hydraulic fluid is provided. The fluid contains a major amount of an organo/phosphate ester base stock; based on the total weight of the fluid of from about 0.5 to 10 wt % of certain alkoxylated polyether amines and from about 4 to about 20 wt % of auxiliary additives selected from the group consisting essentially of antioxidants, VI improvers, rust inhibitors, erosion inhibitors and defoamers.

10 Claims, No Drawings

PHOSPHATE ESTER HYDRAULIC FLUIDS WITH IMPROVED PROPERTIES (LAW935)

FIELD OF INVENTION

This invention relates to aircraft hydraulic fluids containing phosphate ester base stocks as functional fluids and more particularly to the use of certain alkoxylated polyetheramines as additives in such functional fluids for providing improvements in properties such as density, viscosity, lubricity and hydrolytic stability.

BACKGROUND OF INVENTION

Functional fluids are used in a wide variety of applications. For example, they are used as electronic coolants, power transmission and hydraulic fluids, and refrigeration equipment fluids to mention a few. Hydraulic fluids that are to be used in aircraft applications must meet certain performance criteria among which are thermal stability, fire resistance, low susceptibility to viscosity changes over a wide range of temperatures, hydrolytic stability and good lubricity.

In currently available commercial aircraft hydraulic fluids, phosphate esters are the most commonly used base stocks of which tributyl phosphate, isopropylated triphenyl phosphates, n-butyl diphenyl phosphate, and di-n-butyl phenyl phosphate are widely used components.

In use aircraft hydraulic fluids can become contaminated by water; and, as is well known water will cause hydrolysis of phosphate esters to produce partial esters of phosphoric acid. Consequently, phosphate ester based aircraft fluids are formulated to contain an acid scavenger to neutralize any acid or acids produced.

Aircraft components generally are exposed to a very wide temperature range. Therefore, viscosity index improvers are added to aircraft hydraulic fluids to limit the effect of temperature on the viscosity of the fluid composition.

Other additives that are typically used in functional fluids include erosion inhibitors, rust inhibitors, and defoamers.

Although fluid formulators have been successful in developing functional fluid compositions that provide satisfactory properties for aircraft applications, there remains a need for functional fluids that display improved viscosity, lower density, good lubricity and improved hydrolytic stability.

SUMMARY OF INVENTION

Broadly stated, the functional fluid of the present invention comprises a major amount of an organo phosphate ester base stock; from about 0.5 to about 10 wt % of an alkoxylated polyetheramine having the formula

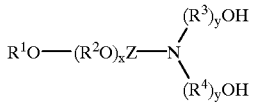

where $R^1$ is a $C_1$ to $C_{24}$ hydrocarbyl group $R^2$, $R^3$ and $R^4$ are independently selected from groups represented by

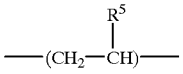

where $R^5$ is hydrogen, methyl or ethyl;

Z is a straight or branched alkylene of from 3 to 4 carbon atoms;

x is 1 to 15; and y is 1 to 15. The functional fluid also contains from about 4 to about 20 wt % based on the total weight of fluid of auxiliary additives selected from the groups consisting of antioxidants, viscosity index improvers, rust inhibitors, erosion inhibitors, acid scavengers, defoamers and mixtures thereof.

The functional fluid is particularly useful as an aircraft hydraulic fluid.

DETAILED DESCRIPTION OF INVENTION

The functional fluids of the present invention includes a major amount of an organic phosphate ester base stock. Typical organo phosphate ester base stocks suitable for use in the present invention include esters selected from triaryl phosphates, trialkyl phosphates, dialkyl aryl phosphates, alkyl diaryl phosphates, and alkylated triaryl phosphates that contain from 3 to 8 and preferably from 4 to 5 carbon atoms in the alkyl groups and mixtures thereof. Examples of the foregoing esters include tri-n-butyl phosphate, tri-isobutyl phosphate, n-butyl di-isobutyl phosphate, di-isobutyl n-butyl phosphate, n-butyl diphenyl phosphate, isobutyl diphenyl phosphate, di-n-butyl phenyl phosphate, di-isobutyl penyl phosphate, tri-n-pentyl phosphate, tri-isopentyl phosphate, triphenyl phosphate, isopropylated triphenyl phosphates and butylated triphenyl phosphates. Preferably, the trialkyl phosphate esters are those of tri-n-butyl phosphate, tri-isobutyl phosphate and mixtures thereof.

The amount of each type of phosphate ester in the functional fluid will vary depending upon the specific properties required for the fluid. An ester base stock for an aircraft hydraulic fluid generally will comprise:

(1) from about 10 wt % to 100 wt % and preferably from 20 wt % to 90 wt % of a trialkyl phosphate;

(2) from 0 wt % to about 15 w % and preferably from 0 wt % to about 50 wt % of a dialkyl ayl phosphate;

(3) from 0 wt % to about 30 wt % and preferably from 0 wt % to about 10 wt % of an alkyldiaryl phosphate;

(4) from 0 wt % to about 20 wt % and preferably from 0 wt % to about 15 wt % of a triaryl phosphate.

The functional fluids of the present invention include an alkoxylated polyetheramine having the formula

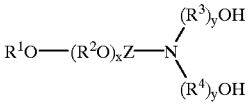

where $R^1$ is a $C_1$ to $C_{24}$ hydrocarbyl group;

$R^2$, $R^3$ and $R^4$ are independently selected from groups represented by

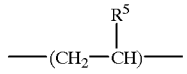

where $R^5$ is hydrogen, methyl or ethyl;

Z is a straight or branched chain divalent alkylene of from 3 to 4 carbon atoms;

x is 1 to 15; and y is 1 to 15; and y is 1 to 15.

With respect to $R^1$ in the above formula suitable hydrocarbyl groups include linear or branched alkyl groups such as methyl, ethyl, n-propyl, isopropyl, n-butyl isobutyl, isobutyl and the like and aryl alkyl groups such as phenyl nonyl and alkyl aryl groups such as pentyl phenyl. In the practice of the present invention $R^1$ preferably is a branched alkyl group of from about 6 to 21 carbon atoms.

Also in the present invention it is preferred that x is in the range of 8 to 15 and y in the range of 1 to 2.

The alkoxylated polyether amines are added to the phosphate ester base stock in amounts ranging from about 0.5 to about 10 wt % based on the total weight of fluid.

Surprisingly, it has been found that the inclusion of alkoxylated polyetheramines in phosphate ester base stocks provides for improved fluid properties such as enhanced low temperature viscosity, hydrolytic stability, lubricity and the like.

In addition to containing the major amount of a phosphate ester base stock and the alkoxylated polyetheramines, the functional fluids of the present invention also include from about 4 wt % to about 20 wt % of auxiliary additives selected from the group consisting essentially of antioxidants, acid scavengers, viscosity index (VI) improvers, rust inhibitors, erosion inhibitors and defoamers.

Useful antioxidants include trialkyphenols, polyphenols and di (alkyl phenyl)amines. These include bis(3,5-di-tert-butyl4-hydroxylphenyl)methane and 1,3,5-trimethyl-2,4,6-tris (3,5-di-tert-butyl-4-hydroxyphenyl)benzene sold under the trade names Hitec®702 and Ethanox®330, respectively by Ethyl Corporation. Other examples of antioxidants include tetrakis (methylene[3,5-di-tert-butyl-4-hydrocinnamate)methane sold under the trade name Irganox®1010 by Ciba-Geigy and di (n-octylphenyl) amine sold under the trade name Vanlube®81 by Vanderbilt. Typically the antioxidant will be used in the range of from about 0.1 wt % to about 2 wt % based on the total weight of the fluid.

Suitable acid scavengers include epoxy compounds such as expoxycyclohexane alkyl carboxylates, an example of which is 3.4-epoxycyclohexane-2-ethylhexyl carboxylate described in U.S. Pat. No. 3,723,320. Typically the acid scavenger will be used in an amount ranging from about 1 to about 10 wt % based on the total weight of the functional fluid.

Erosion inhibitors that are suitable for use in the compositions of the present invention include alkali metal salts of perfluoroalkyl sulfonic acids such as potassium perfluorooctyl sulfonate sold under the trade name FC®98 and available from 3M Company. Typically the erosion inhibitor will be present in an amount ranging from about 0.01 wt % to about 0.1 wt % based on the total weight of the functional fluid.

Suitable VI improver additives include polyacrylate esters having a number average molecular weight in the range of about 50,000 to 100,000. Such poly alkyl methacrylates sold as PA®-7570, PA®-6703, PA®-6744, and PA®-6961-PMN by Rhom and Haas Company. Typically the VI improver will be used in an amount ranging from about 3 wt % to about 10 wt % based on the total weight of the functional fluid.

The functional fluids described herein optionally contain further conventional additions such as metal corrosion inhibitors, anti-foaming agents, dyes, etc.

EXAMPLES

Unless otherwise stated all percents recited in the examples are percents by weight.

Example 1

Formulation 1, a formulation of this invention, was prepared by blending the following components:

| Component | Amount, wt % |
|---|---|
| Base Stock | |
| Tributyl Phosphate | 80.0836 |
| Ethoxylated polyether amine[(1)] | 7.0 |
| Auxiliary Additives | |
| Antioxidants | 1.5 |
| VI Improvers | 5.625 |
| Acid scavenger | 5.7 |
| Other Additives | |
| Corrosion Inhibitors | 0.01 |
| Dye | 0.0014 |
| Defoamer | 0.01 |
| Erosion Inhibitor | 0.07 |

[(1)]This amine had the formula

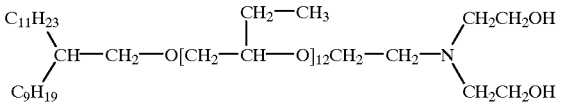

Comparative Example 1

A formulation, Formulation 2, was prepared without any alkoxylated polyether amine but with the same auxiliary additives in the same amounts as Formulation 1 and with a base stock comprising a mixture of 74.9336 wt % tributylphosphate and 12.1 wt % of isopropylated triphenyl phosphates.

Comparative Example 2

A formulation, Formulation 3, was prepared using as the base stock 32.3586 wt % tnbutyl phosphate, 35.7 wt % tri-isobutyl phosphate and 12.1 wt % isopropylated triphenyl phosphates. Formulation 3 did not contain any alkoxylated polyether amine but did contain the same auxiliary additives in the same amounts as Formulation 1 and substantially the same additional additives as Formulation 1.

Example 2

This example shows that the addition of the alkoxylated polyether amine to the phosphate ester base stock (Formulation 1) provides desirable low viscosity at −65° F. and low density when compared to Formulations 2 and 3. See Table 1.

TABLE 1

| Properties | Formulation 1 | Formulation 2 | Formulation 3 |
|---|---|---|---|
| Density @ 25° C. | 0.9742 | 0.9959 | 0.9916 |
| Specific Gravity, 25° C./25° C. | 0.9771 | 0.9988 | 0.9945 |
| Viscosity @ −65° F., cSt | 816 | 879 | 1668 |

Example 3

This example demonstrates that the addition of the alkoxylated polyether amine to the phosphate ester base stock (Formulation 1) has a higher titratable acid receptor than Formulation 2 and 3. See Table 2.

TABLE 2

| Properties | Formulation 1 | Formulation 2 | Formulation 3 |
|---|---|---|---|
| Acid Receptor, % | 117.8 | 100 | 100 |

Example 4

The hydrolytic stability of Formulation 1 and Formulation 2 was determined by heating each at 280° F. with 0.8 wt % water and periodically determining the percent titratable acid receptor. The results show that Formulation 1 provides superior hydrolytic stability compared with Formulation 2 and 3. See Table 3.

TABLE 3

| Properties | Formulation 1 | Formulation 2 | Formulation 3 |
|---|---|---|---|
| Acid receptor, % of new at | | | |
| 0 hours | 117.5 | 100 | 100 |
| 96 hours | — | 58.9 | 65.9 |
| 144 hours | 80.0 | — | — |
| 168 hours | — | 34.9 | 42.2 |
| 216 hours | 64.3 | — | 16.7 |
| 264 hours | — | 4.4 | — |
| 312 hours | 44.6 | — | — |
| 384 hours | 32.4 | | |

Example 5

The lubricity performance of Formulation 1 and Formulation 3 was evaluated by the Four Ball Wear Test (ASTM D-4172) using aircraft manufacturer specifications (167° F., 600 RPM, 1 hour). A 40 kg load was used and the test was performed in duplicate. The results are given in Table 4.

TABLE 4

| | Formulation 1 | Formulation 3 |
|---|---|---|
| Wear Scar Diameter, mm | 0.59/0.59 | 0.68/0.66 |

This example shows that the addition of the alkoxylated polyether amine to the phosphate ester base stock (Formulation 1) provides unexpected good lubricity performance.

What is claimed is:

1. A functional fluid comprising:

(a) a major amount of an organo phosphate ester base stock;

(b) from about 0.5 to 10 wt % based on the total weight of the fluid of an alkoxylated polyether amine having the formula

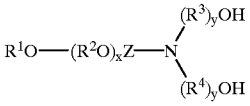

where $R^1$ is a $C_1$ to $C_{24}$ hydrocarbyl group $R^2$, $R^3$ and $R^4$ are independently selected from groups represented by

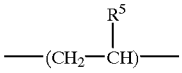

where $R^1$ is hydrogen, methyl or ethyl;

Z is a straight or branched alkylene of from 3 to 4 carbon atoms;

x is 1 to 15; and y is 1 to 15; and (c) from about 4 to about 20 wt %, based on the total weight of the fluid, of auxiliary additives selected from the group consisting of antioxidants, viscosity index improvers, erosion inhibitors, acid scavengers and mixtures thereof.

2. The functional fluid of claim 1 wherein the organo phosphate ester base stock comprises:

(i) from about 10 wt % to 100 wt % of a trialkylphosphate;

(ii) from 0 wt % to about 75 wt % of a dialkyl aryl phosphate;

(iii) from 0 wt % to about 30 wt % of an alkyl diaryl phosphate;

(iv) from 0 wt % to about 15 wt % of a triaryl phosphate.

3. The functional fluid of claim 2 wherein the alkyl groups of the esters have 4 to 5 carbon atoms.

4. The functional fluid of claim 3 wherein x is from 8 to 12.

5. The functional fluid of claim 4 wherein y is 1.

6. The functional fluid of claim 4 wherein $R^2$ is

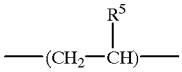

and $R^5$ is ethyl.

7. The functional fluid of claim 6 wherein $R^3$ and $R^4$ are

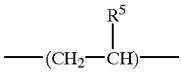

and $R^5$ is hydrogen.

8. A hydraulic fluid comprising (a) a major amount of an organo phosphate extra base stock comprising:

(i) from about 10 w % to 100 wt % of a trialkylphosphate;

(ii) from 0 wt % to about 75 wt % of a dialkyl aryl phosphate;

(iii) from 0 wt % to about 30 wt % of an alkyl diaryl phosphate;

(iv) from 0 wt % to about 15 wt % of a triaryl phosphate.

(b) from about 05 to 10 wt % based on the total weight of the fluid of an alkoxylated polyether amine having the formula

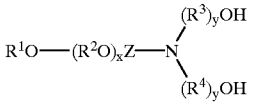

where $R^1$ is a $C_1$ to $C_{24}$ hydrocarbyl group $R^2$, $R^3$ and $R^4$ are independently selected from groups represented by

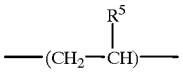

where $R^5$ is hydrogen, methyl or ethyl;

Z is a straight or branched alkylene of from 3 to 4 carbon atoms;

x is 1 to 15; and y is 1 to 15; and (c) from about 4 to about 20 wt %, based on the total weight of the fluid, of auxiliary additives selected from the group consisting of antioxidants, viscosity index improvers, erosion inhibitors, acid scavengers and mixtures thereof.

9. The fluid of claim 8 wherein the base stock comprises 100 wt % of a trialkyl phosphate having 4 to 5 carbons in the alkyl group.

10. The fluid of claim 9 wherein the basestock is tributyl phosphate; an in the formula, x is from 8 to 10, y is 1, $R^2$ is

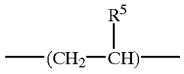

and $R^5$ is ethyl; and $R^3$ and $R^4$ are

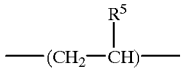

and $R^5$ is hydrogen.

* * * * *